US011142878B1

(12) United States Patent
Aleali et al.

(10) Patent No.: US 11,142,878 B1
(45) Date of Patent: Oct. 12, 2021

(54) BIO-INSPIRED DEEP FOUNDATION PILE AND ANCHORAGE SYSTEM

(71) Applicant: Arrowhead Center, Inc., Las Cruces, NM (US)

(72) Inventors: Seyedali Aleali, Las Cruces, NM (US); Paola Bandini, Las Cruces, NM (US); Craig M. Newtson, Las Cruces, NM (US)

(73) Assignee: Arrowhead Center, Inc., Las Cruces, NM (US)

( * ) Notice: Subject to any disclaimer, the term of this patent is extended or adjusted under 35 U.S.C. 154(b) by 0 days.

(21) Appl. No.: 16/726,071

(22) Filed: Dec. 23, 2019

Related U.S. Application Data

(60) Provisional application No. 62/809,331, filed on Feb. 22, 2019.

(51) Int. Cl.

| | |
|---|---|
| ***E02D 5/80*** | (2006.01) |
| ***E02D 5/54*** | (2006.01) |
| ***E02D 5/28*** | (2006.01) |
| ***E02D 5/74*** | (2006.01) |
| ***E02D 5/26*** | (2006.01) |

(52) U.S. Cl.
CPC ..... *E02D 5/80* (2013.01); *E02D 5/26* (2013.01); *E02D 5/285* (2013.01); *E02D 5/54* (2013.01); *E02D 5/74* (2013.01); *E02D 5/803* (2013.01); *E02D 5/805* (2013.01); *E02D 2200/1685* (2013.01); *E02D 2300/0029* (2013.01); *E02D 2300/0071* (2013.01); *E02D 2600/30* (2013.01)

(58) Field of Classification Search
CPC ..... E02D 5/52; E02D 5/523; E02D 5/526; E02D 5/54; E02D 5/80; E02D 5/803; E21D 21/0026; E21D 21/0033; E21D 21/004; E21D 21/0073; E21D 21/008
USPC ..... 405/259.1, 259.3, 262; 52/159, 160, 161
See application file for complete search history.

(56) References Cited

U.S. PATENT DOCUMENTS 1,807,488 A * 5/1931 Michalicek ..... E02D 5/803 52/159
3,012,644 A * 12/1961 Bush ..... E02D 5/803 52/162
3,214,918 A * 11/1965 Binnings ..... E02D 7/30 405/246

(Continued)

OTHER PUBLICATIONS

Winter, V, Amos G., et al., "Identification and Evaluation of the Atlantic Razor Clam (*Ensis directus*) for Biologically Inspired Subsea Burrowing Systems", Integrative and Comparative Biology, vol. 51, No. 1, Oxford University Press, Jun. 11, 2011, 151-157.

(Continued)

*Primary Examiner* — Frederick L Lagman
(74) *Attorney, Agent, or Firm* — Peacock Law P.C.; Justin R. Jackson; Deborah A. Peacock

(57) ABSTRACT

An expanding anchor and/or pile system wherein an outer shell of the pile/anchor is split lengthwise into at least two pieces and can be placed or driven into a hole in the earth in a retracted state and can subsequently be expanded such that the two or more pieces are forced outwardly—away from one another, thus causing them to exert a lateral force against the sides of the hole and thereby resulting in greater axial load carrying capacity in tension or compression of the anchor/pile.

24 Claims, 12 Drawing Sheets

(56) References Cited

U.S. PATENT DOCUMENTS

| | | | | |
|---|---|---|---|---|
| 3,324,666 | A * | 6/1967 | Lee | E02D 5/72 405/231 |
| 3,512,319 | A * | 5/1970 | Piacentino | E02D 5/803 52/160 |
| 4,160,613 | A * | 7/1979 | Stanwick | E02D 5/74 405/244 |
| 4,547,106 | A * | 10/1985 | Lipsker | E02D 5/803 405/237 |
| 4,768,900 | A * | 9/1988 | Burland | E02D 5/54 405/232 |
| 6,210,077 | B1 * | 4/2001 | Kondo | E02D 5/801 175/98 |
| 6,401,407 | B1 * | 6/2002 | Humphrey | E02D 17/10 52/153 |
| 6,793,444 | B2 * | 9/2004 | Kondo | E02D 33/00 175/98 |
| 9,540,783 | B2 * | 1/2017 | Lymberis | E04H 9/021 |
| 2015/0252546 | A1 * | 9/2015 | Berger | E04H 12/2215 52/160 |

OTHER PUBLICATIONS

Winter, V, Amos G., et al., "Localized fluidization burrowing mechanics of Ensis directus", The Journal of Experimental Biology, Vo. 215, The Company of Biologists Ltd, 2012, 2072-2080.

Winter, V, A. G., et al., "Razor clam to RoboClam: burrowing drag reduction mechanisms and their robotic adaptation", Bioinspiration & Biomimetics, vol. 9, IOP Publishing Ltd., U.K., 2014, 1-11.

* cited by examiner

BIO-INSPIRED DEEP FOUNDATION PILE AND ANCHORAGE SYSTEM

CROSS-REFERENCE TO RELATED APPLICATIONS

This application claims priority to and the benefit of the filing of U.S. Provisional patent Application No. 62/809,331, entitled "Bio-Inspired Deep Foundation Piles and Anchorage Systems", filed on Feb. 22, 2019, and the specification thereof is incorporated herein by reference.

STATEMENT REGARDING FEDERALLY SPONSORED RESEARCH OR DEVELOPMENT

This invention was made with government support under award No. EEC-1449501 awarded by the National Science Foundation. The government has certain rights in the invention.

BACKGROUND OF THE INVENTION

As used throughout this application, the term "anchor/pile" is intended to include an anchor and/or a pile". Embodiments of the present invention relate to foundation piles and anchorage systems. More particularly, embodiments of the present invention relate to foundation piles and anchorage systems which feature a pile/anchor which can be expanded laterally once installed to increase the holding power and/or load carrying capacity of the anchor/pile.

Deep foundation systems transfer loads, for example the load of a building or bridge, far down into the earth. One commonly employed deep foundation system is a vertical structural element called a "pile". Conventional pile foundations include drilled shafts or bored piles, and steel, wood or precast concrete driven piles. The vertical load capacity of these conventional pile systems under downward and/or upward loading from structures and the pullout capacity of ground anchors can be increased by incorporating unique features to these load-carrying systems that are found in some biological organisms. What is needed are deep foundation pile systems and anchorage systems that incorporate some of these biologically inspired characteristics to achieve greater load-carrying capacity.

The earthworm and the razor clam are two animals that provide biological examples of strategies of how an elongated object or body might be anchored and vary the earth pressure surrounding it. The razor clam has an elongated shape and has a hinged bivalve shell that is split longitudinally (along its axis of length). The bivalve shell provides the razor clam the ability to anchor itself in the surrounding sand by opening (radially or laterally expanding) its shell while pushing the front part (called the foot) of its soft body forward. The bivalve shell also provides the razor clam the ability to release itself from the surrounding sand by closing (radially or laterally contracting) its shell.

The earthworm, like many invertebrates, has a hydrostatic skeleton (also called a hydroskeleton). The hydroskeleton of invertebrates is composed of incompressible fluid and surrounding tissues that contain the fluid. When an external load is applied to the hydroskeleton, the hydroskeleton transfers that load to the internal fluid and converts it into hydrostatic pressure, which has equal magnitude in all directions at any given point. This hydrostatic pressure eventually becomes internal stress on the interior of the supporting walls (tissues) of the hydrostatic skeleton. Earthworms can use their hydrostatic structure to anchor their body laterally while pushing forward to advance into the soil. When the earthworm and razor clam expand laterally, the lateral earth pressure in the surrounding soil increases and provides anchorage. Additionally, earthworms have *setae*, which are bristle or hair-like structures on the outside surface of their body. When the earthworm expands part of its body laterally, these *setae* are extended by the worm's protractor muscles into the surrounding soil to anchor the worm's body. The *setae* embedded into the surrounding soil also contribute to anchorage.

What is needed are deep foundation piles and anchorage systems that mimic aspects of the characteristics of the earthworm and razor clam to provide a greater lateral earth pressure and/or anchorage that lead to greater shaft resistance (also called "skin resistance" or "frictional resistance") in the case of piles and greater pullout resistance in the case of piles and anchoring systems.

BRIEF SUMMARY OF EMBODIMENTS OF THE PRESENT INVENTION

Embodiments of the present invention relate to an earth anchor/pile system having a multiple-part shell formed from a plurality of elongated members, the plurality of elongated members configured to move away from one another to provide an expanded configuration of the earth anchor/pile system, the plurality of elongated members configured to move toward one another to provide a contracted configuration of the earth anchor/pile system, and the earth anchor/pile system securable in the expanded configuration. The earth anchor/pile system can also include a nearly incompressible core disposed within at least a lower portion of the multiple-part shell and can include a driving shoe disposed at an end portion of the multiple-part shell. The multiple-part shell can include a two-part shell and the plurality of elongated members can be a plurality of curved elongated members. The multiple-part shell can include an at least substantially circular shape when in a contracted configuration. The earth anchor/pile system can also include a filler material disposed within at least an upper portion of the multiple-part shell. In one embodiment, the top slab can be formed above the multiple-part shell. A plurality of tension members can extend from above the top slab and connect to one or more of the plurality of elongated members. Preferably, the earth anchor/pile system is configured to expand when the plurality of elongated members are placed in tension and forcing the top slab closer to a bottom end portion of the plurality of elongated members causes the plurality of elongated members to move away from one another, thus expanding the earth anchor/pile system In one embodiment, the earth anchor/pile system can also include a plurality of mechanical expansion devices disposed within the multi-part shell and configured such that actuation of the plurality of mechanical expansion devices forces the elongated members to move away from each other or closer to each other. The earth anchor/pile system can also include a plurality of projections that project at least substantially laterally away from an outside surface of the multiple-part shell. Optionally the plurality of mechanical expansion devices can include a jackscrew and be configured such that rotation of the jackscrew in a first direction causes the plurality of mechanical expansion devices to extend and such that rotation of the jackscrew in a second direction causes the plurality of mechanical expansion devices to retract.

The earth anchor/pile system can be securable in the expanded configuration by disposing filler material within an inner portion of the multiple-part shell when the multiple-part shell is in the extended configuration. Optionally, the filler material can include a cement material with or without steel reinforcement. The plurality of projections can include metal spikes and/or metal elongated members. The plurality of projections can be disposed on a surface of the plurality of elongated members and/or can be incorporated or otherwise formed on the plurality of elongated members. The plurality of elongated members can optionally be two elongated members. The plurality of elongated members can include one or more openings through which one or more elongated holding members can project.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more embodiments of the invention and are not to be construed as limiting the invention. In the drawings:

FIGS. 4B and 40 are top views showing a mechanical expansion device, similar to a scissor jack, of the *setae* anchored pile before (FIG. 4B) and after (FIG. 40) expansion of the mechanical expansion device within the pile;

DETAILED DESCRIPTION OF THE INVENTION

Embodiments of the present invention relate to an anchor and/or pile system. Discussions related to the structure, and/or installation of either the anchor or the pile system are equally applicable for the other as it is understood that the same installed structure can function as a pile when a downward-force is applied to it and can function as an anchor when an upward force is applied to that same installed structure. As used throughout this application, the term "superstructure" is intended to include any structure of any shape and dimension that pile system 10 supports or serves as the foundation of, including but not limited to buildings, bridges, photovoltaic solar panels, oil rigs, any other structure, apparatus or device, combinations thereof, and the like.

Referring now to the figures, particularly FIGS. 1A-3B, embodiments of pile system 10, also occasionally referred to as a bio-inspired radially expansive pile ('BREP") of the present invention preferably comprise a two-part shell (or longitudinally split pipe) 12 that forms the outer shell of pile system 10 and nearly incompressible core 30 inside the shell of pile system 10. Like the split shell of a razor clam (also called a "bivalve shell"), two-part shell 12 provides an outer shell for pile system 10 and keeps pile system 10 together but allows pile system 10 to expand because its two separate halves can separate from each other. After pile system 10 is placed into the ground, nearly incompressible core 30, located inside two-part shell 12, is compressed along the longitudinal direction so that nearly incompressible core 30 expands in the lateral (radial) direction. Lateral expansion of nearly incompressible core 30 increases the lateral earth pressure on two-part shell 12 and the shaft resistance of pile system 10. Preferably, two-part shell 12 is a longitudinally split steel pipe (or in other words, two steel half-pipes). Other embodiments of two-part shell 12 can be formed of materials other than steel, including but not limited to plastic, wood, other metals or metal alloys, and combinations thereof. Some embodiments of two-part shell 12 comprise more than two halves, but are split multiple times, for example in thirds, fourths, or smaller increments. Thus, discussions herein related to "two-part shell 12" are intended to be applicable to embodiments of the present invention wherein more than two parts form shell 12.

Figure 1A:
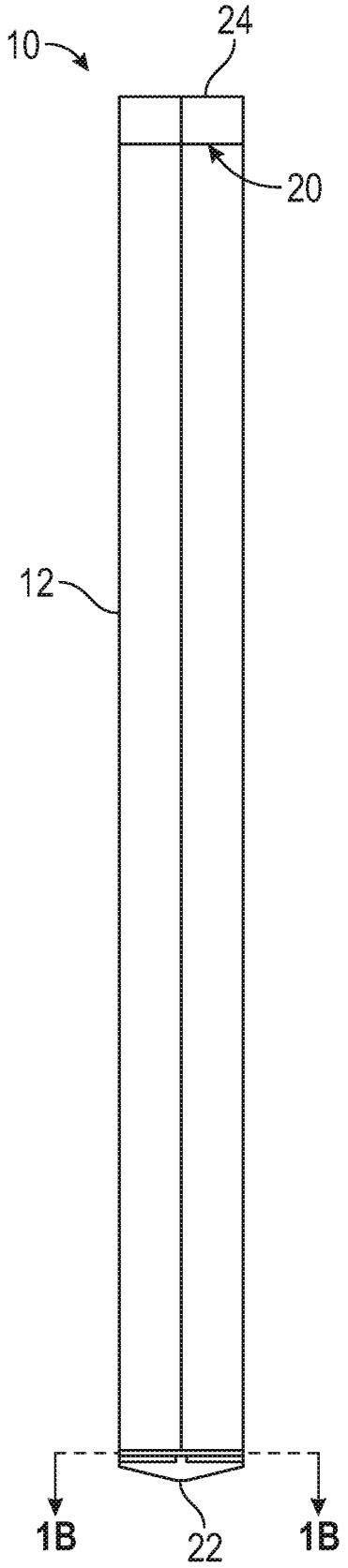
FIG. 1A is a drawing which illustrates a side sectional view of a radially expansive pile before it is installed in the earth, comprising a two-part shell, according to an embodiment of the present invention.
Figure 1B:
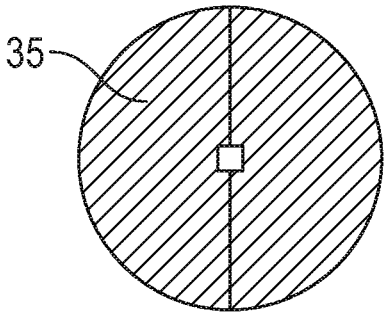
FIG. 1B is a drawing which illustrates a section view along line 1B-1B of FIG. 1A which illustrates a pair of half circle plates according to an embodiment of the present invention.
Figure 1C:
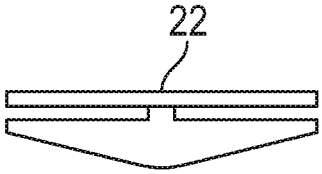
FIGS. 1C and 1D respectively illustrate drawings of a driving shoe and a pile driving cap of a radially expansive pile in accordance with an embodiment of the present invention.
Figure 1D:
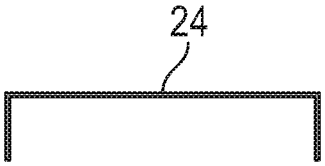

FIGS. 1A-3B illustrate a bio-inspired radially expansive pile system 10 according to an embodiment of the present invention. FIG. 1A illustrates a radially expansive pile system 10 prior to it being installed into the earth, FIG. 2A illustrates it after it is installed in the ground; and the right side of FIG. 3A is a more detailed view of it after installation and expansion with reference number 43 illustrating the outward force exerted by the expansion of pile system 10.

Referring to FIG. 1A, pile system 10 preferably comprises a series of lateral belts 20 that limit the lateral deflection or expansion of pile system 10 and prevent separation of the two halves of two-part shell 12 during transportation, handling, installation and service. Preferably, lateral belts 20 are formed of steel, but can optionally be formed of any material adequate to maintain its hold around two-part shell 12 during transportation, handling, installation and service, including plastic, leather, rubber, synthetic materials, combinations thereof, and the like. Optionally, the material can be determined based on the intended expansion forces of pile system 10, the environment in which pile system 10 is installed, and the intended length of time lateral belts 20 are needed to stay intact. Optionally, lateral belts 20 need not have a belt-and-buckle like configuration but can instead comprise another configuration that can also keep two-part shell 12 from expanding excessively. In one embodiment, belts 20 can include some interlocking rings or some other structure that allows for some limited amount of movement.

Embodiments of pile system 10 may comprise other components to keep it together during installation. Preferably, pile system 10 comprises a driving shoe 22 and driving cap 24 as is respectively illustrated in FIGS. 1C and 1D. Driving cap 24 not only prevents damage to pile system 10 while it is driven into the earth during installation, but also maintains the relative positions of the two halves of two-part shell 12. In addition, each one of the two halves of two-part shell 12 comprises a half-circle plate 35 that is welded or attached to the bottom of the half shell. Half-circle plates 35 preferably at least substantially abut one another when two-part shell 12 is in a contracted configuration. Most preferably each of two half-circle plates 35 comprises a notch at a center portion thereof such that when abutted together to form a circle, an opening is formed in a center thereof and through which a stud of driving shoe passes such that each half-circle can rest at least substantially within a circular gap formed within driving shoe 22, thus holding driving shoe 22 in place with respect to two-part shell 12.

Figure 1E:
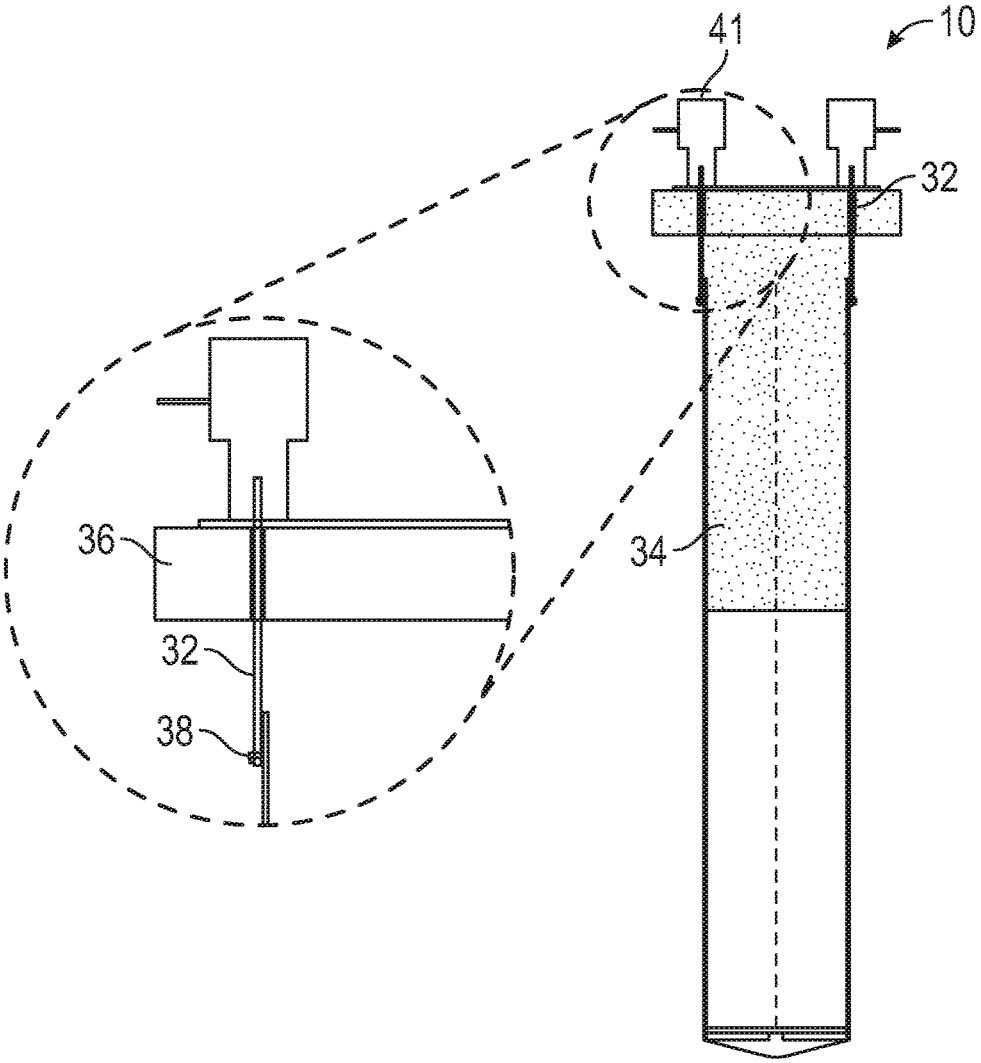
FIG. 1E is a drawing which illustrates a side sectional view with a close-up detail of the tension rods and connection thereof to a two-part shell according to an embodiment of the present invention.
Figure 1F:
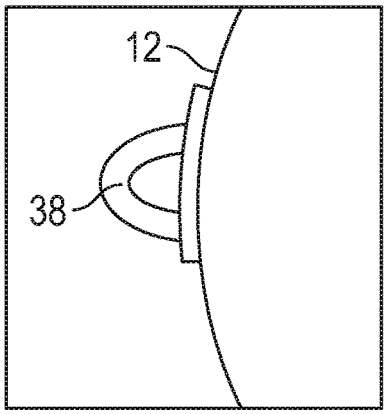
FIG. 1F is a drawing showing a D-ring connected to a two-part shell according to an embodiment of the present invention.

Pile system 10 is driven into the earth for installation. At this stage, its interior is preferably empty as illustrated in FIG. 1A. After the pile system 10 is driven, its interior is partially filled of nearly incompressible core material 30. Nearly incompressible core material 30 preferably fills a portion of two-part shell 12, which can include about the lower two-thirds of two-part shell 12 or less. The remaining interior of pile 10 is preferably filled with filler material 34 which can include, for example, reinforced concrete and which can optionally include top slab 36. Nearly incompressible core 30 is preferably loaded in compression along the vertical axis of the pile to expand it radially. The compression of the core 30 can optionally be accomplished using tension rods 32 which can be pulled by one or more hydraulic jacks 41 to push down filler material 34, thus compressing nearly incompressible core 30. Alternatively, of course, other structures, devices and apparatuses can be used to pull tension rods 32. After the compression is accomplished, the compression of the core 30 is preferably locked using bolts and nuts 37 that also connect the two-part shell 12 with the top slab 36. Optionally, the other end of tension rod 32 and/or any connecting cables can optionally be attached to a point below—for example to one or more members or components of two-part shell 12. As best illustrated in FIGS. 1E and 1F, one manner in which tension rods 32 can connect to two-part shell 12 is via ring 38 (which can optionally be a D-shaped ring), attached to a side of two-part shell 12. Most preferably, one or more tubes or pipes are disposed within top slab 36 through which tension rods 32 translate. A bottom end of tension rods 32 preferably each extend through a respective one or more of rings 38 and preferably have a knob, nut, or some other type of enlarged area formed or disposed on an end portion thereof which cannot pass through ring 38. Thus, when lifting mechanism, which can be hydraulic jack 41 pulls up on tension rod 32, the enlarged area on the end of rod 32 engages ring 38 and thus forces filler material 34 downward with respect to two-part shell 12, thus expanding pile system 10.

Preferably, nearly incompressible core 30 is formed from a nearly incompressible and flexible material, including but not limited to natural or synthetic rubber, compressed recycled rubber, polypropylene, dense granular material which can include soil, and/or a fluid confined inside a chamber or membrane. In this way, pile system 10 employs the benefits that give hydrostatic skeletons of invertebrates their advantages. Pile system 10 can provide greater pile capacity compared with a conventional pile foundation of same external dimensions because the radial expansion of nearly incompressible core 30 that fills certain spaces within two-part shell 12 causes the lateral earth pressure to increase in the surrounding soil, which provides greater shaft resistance. Embodiments of pile system 10 can employ various types of core material 30 that are nearly or substantially incompressible yet are preferably flexible, and/or combinations of different materials thereof. In some embodiments, various separate sections of different core material 30 can be provided within pile system 10, which can optionally have different characteristics to accomplish different amounts of flexibility, expansion, rigidity, temperature tolerance, etc.

Embodiments of the present invention can provide a deep foundation pile that can expand variably and that can employ the characteristics of hydrostatic skeletons of invertebrates that enhance the technology of pile foundations. Preferably, pile system 10 is at least partially filled with incompressible core 30 along at least a portion of the system's longitudinal axis. Additionally, by filling pile system 10 in variable amounts and with varying materials, the lateral expansion of two-part shell 12 can be designed or varied, thereby controlling the magnitude of lateral earth pressure in the surrounding soil against two-part shell 12. The radial expansion of nearly incompressible core 30 pushes two-part shell 12 apart against the surrounding soil. The reaction of the soil increases the confining earth pressure applied on the outer surface of two-part shell 12. After pile system 10 is completed and the load from the superstructure is applied on it, the greater confinement allows greater shaft resistance and consequently greater load capacity of the pile foundation.

Figure 2A:
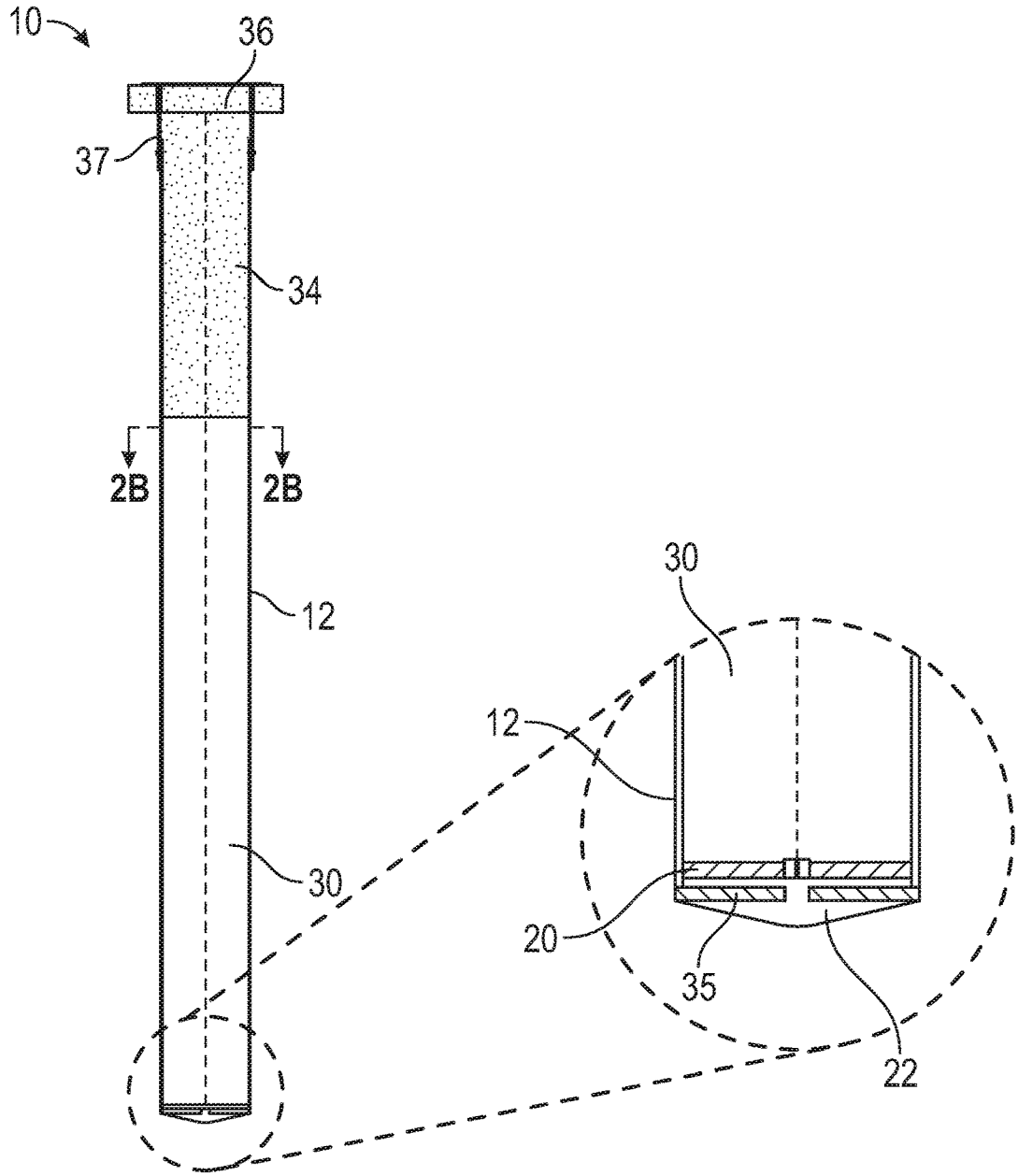
FIG. 2A is a drawing which illustrates a side sectional view of a radially expansive pile after it is installed in the earth, comprising a two-part shell according to an embodiment of the present invention, and which illustrates a close-up view of a bottom portion of the radially expansive pile according to an embodiment of the present invention, the vertical broken line illustrating a line of symmetry.
Figure 2B:
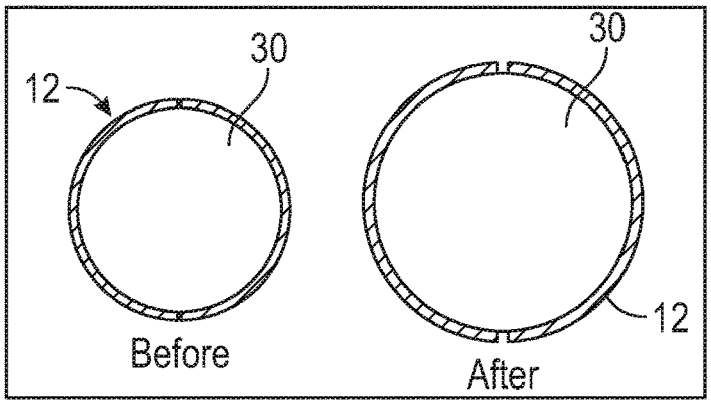
FIG. 2B is a drawing which illustrates views along line 2B-2B of FIG. 2A and which thus show the two-part shell of the radially expansive pile before (left) and after (right) expansion.
Figure 3A:
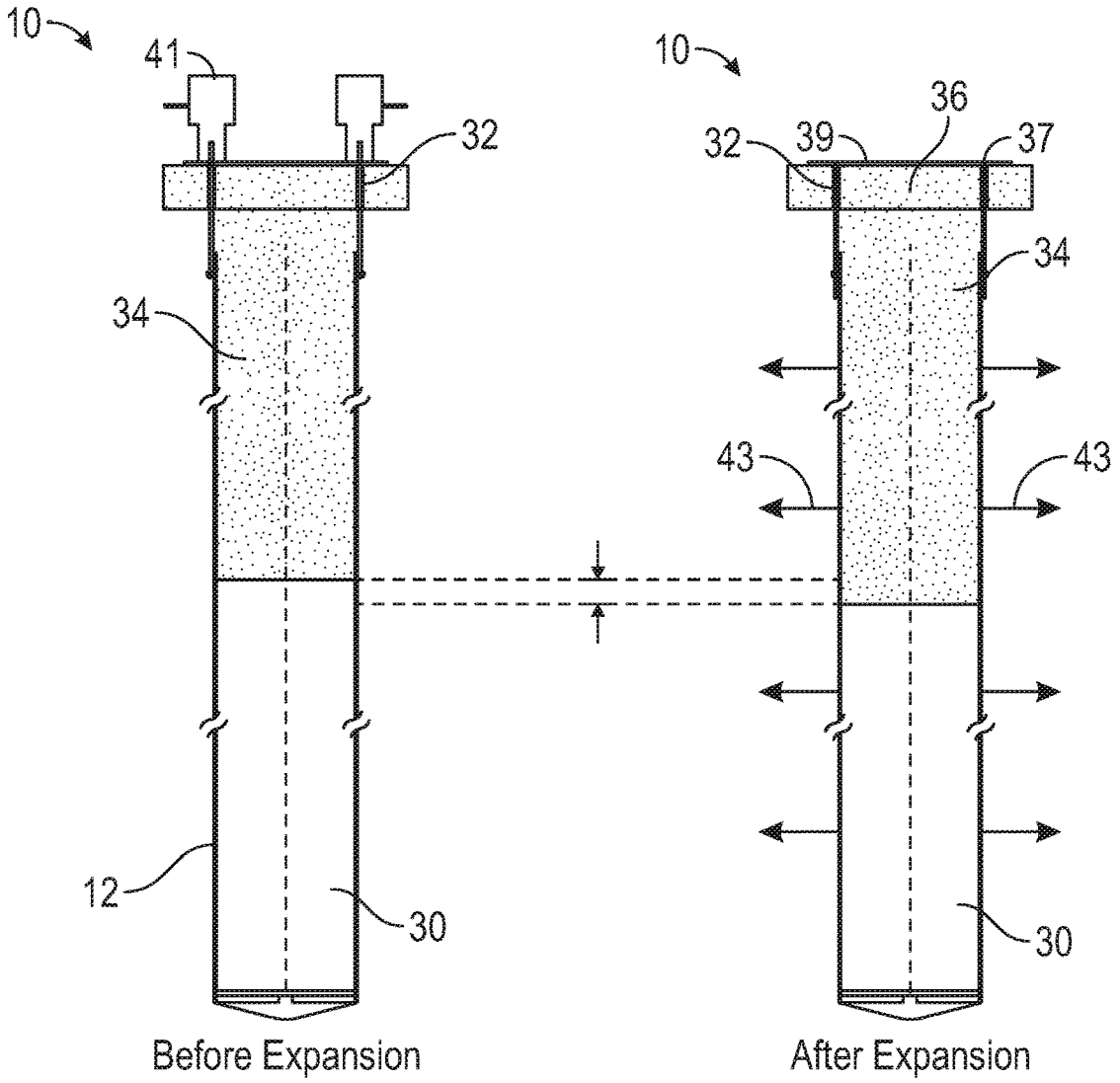
FIG. 3A 3A is a drawing which illustrates more detailed side sectional views of a radially expansive pile before (left) and after (right) it is installed and expanded in the earth, comprising a two-part shell according to an embodiment of the present invention, the vertical broken lines illustrating a line of symmetry.
Figure 3B:
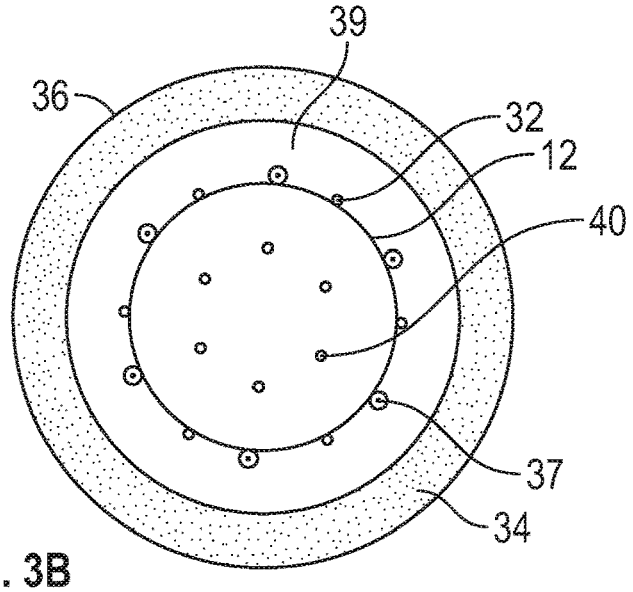
FIG. 3B is a drawing which illustrates a top view of the radially expansive pile of FIG. 3A after it is installed in the ground.

Pile system 10 can also coordinate with other components so that it can support superstructures as their foundation. To accomplish this, as is best illustrated in FIGS. 2A and 3A; a portion of space within two-part shell 12 is preferably filled with filler material 34, which can optionally include reinforced concrete or another filling material that can be used to support loads. As illustrated in FIGS. 2A and 3A, the upper about one-third of two-part shell 12 is filled with filler material 34. In some embodiments, filler material 34 can fill all remaining space within two-part shell 12 that is not filled with incompressible core 30. The amount or proportion of filler material 34 used in pile system 10 preferably varies depending on the desired expansion of the particular pile system 10, type and characteristics of the surrounding soil, the load from the superstructure, and any other desired factors. Additionally, pile system 10 preferably comprises a top slab 36 (also called "pile cap") that serves as the cap of pile system 10. Top slab 36, and other various elements such as base plate 39, supports other objects such as a column of the superstructure. Optionally, base plate 39, which can be formed from metal, including but not limited to steel or stainless steel can be disposed atop slab 36. In one embodiment, rebar dowels 40 (see FIG. 3B) can be embedded within filler material and can extend up through top slab 36, and if provided, up through base plate 39 to wait for superstructure construction.

Pile system 10 can also provide greater shaft resistance when pile system 10 is loaded in tension. Pile system 10 preferably comprises mechanisms to transfer a pullout force (or tensile load) to two-part shell 12. Preferably, top slab 36, and if provided base plate 39, are connected to two-part shell 12 through bolts and nuts 37. In this way, when pile system 10 is loaded in tension, bolts and nuts 37 transfer the force to two-part shell 12. Optionally, other pull-out apparatuses, structures, devices, and combinations thereof can be provided in pile system 10 other than bolts and nuts, including but not limited to, for example rods and pins, cables, combinations thereof, and the like.

Figure 4A:
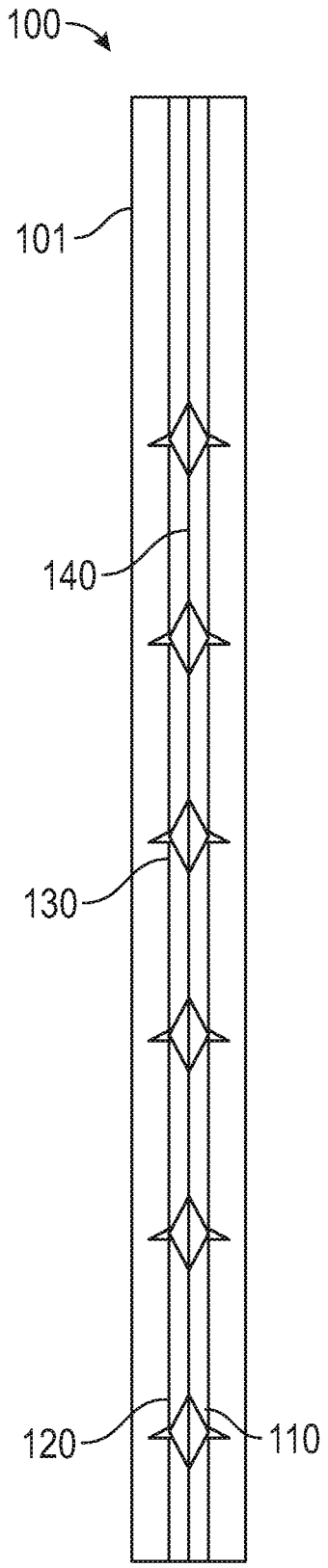
FIG. 4A is a drawing which illustrates a side sectional view of a *setae* anchored pile before lateral expansion, comprising a mechanical expansion device according to an embodiment of the present invention.
Figure 4B:
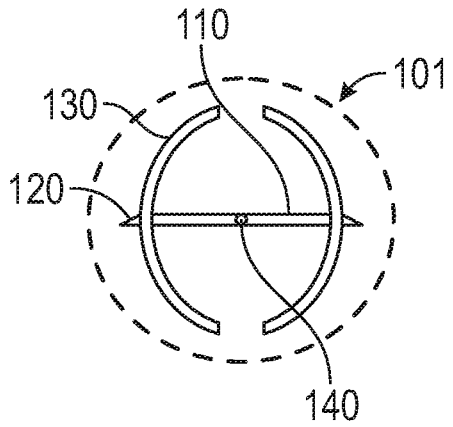
Figure 4C:
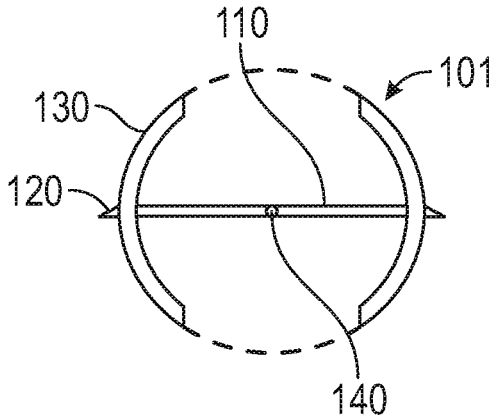
Figure 5:
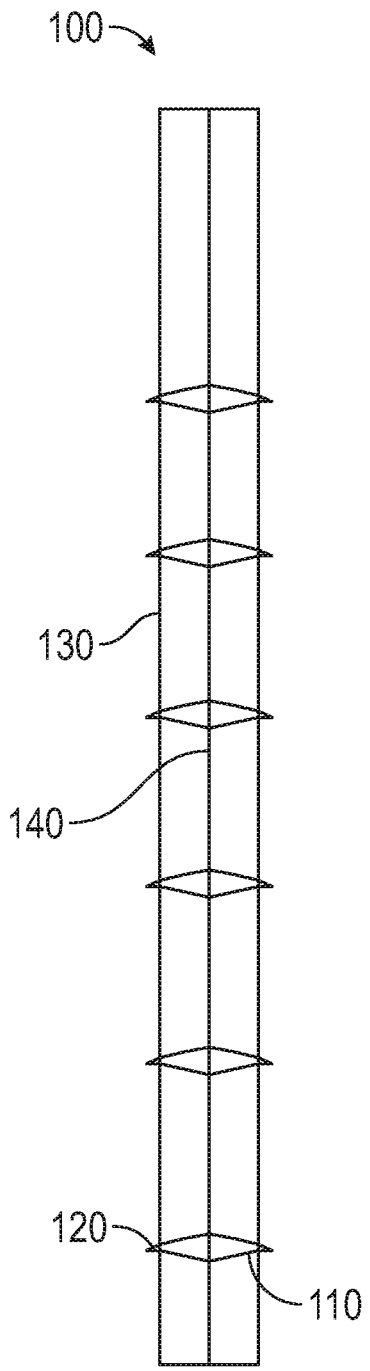
FIG. 5 is a drawing which illustrates a side sectional view of a *setae* anchored pile after lateral expansion, according to an embodiment of the present invention.
Figure 6:
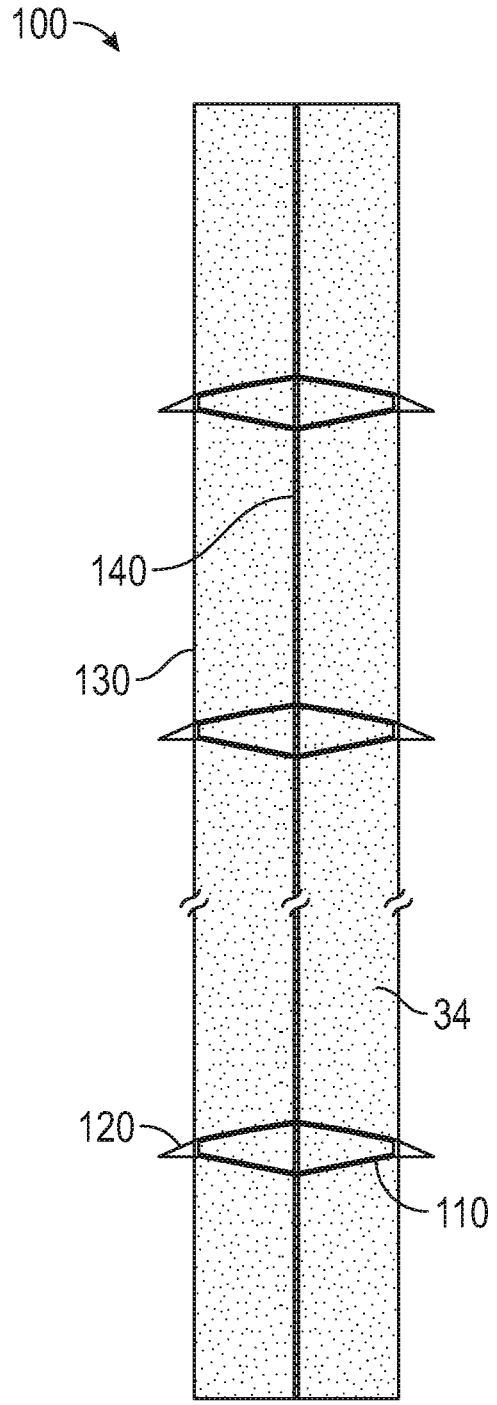
FIG. 6 is a drawing which illustrates a more detailed side sectional view of a *setae* anchored pile.

Embodiments of the present invention also comprise bio-inspired mechanisms for anchoring deep foundation piles and other systems. FIGS. 4A-6 illustrate a bio-inspired "*setae* anchored" pile system 100 according to an embodiment of the present invention. FIG. 4A illustrates the *setae* anchored pile system 100 prior to the anchoring system being expanded. FIG. 5 illustrates the *setae* anchored pile system 100 after the *setae* anchored pile system has been expanded in the earth; and FIG. 6 illustrates a more-detailed view of it after expansion.

Most preferably, expansive pile system 100 is disposed within an opening in the ground. This embodiment of the present invention can expand radially or laterally like the shell or body of a razor clam and earthworm that anchor themselves in the earth and generate traction to advance the tip of theft body forward. Referring now to FIGS. 4A-6, embodiments of *setae* anchored pile system 100, also occasionally referred to as a bio-inspired *setae* anchored pile ("BSAP"), preferably comprise shell 130 that is most preferably a two-part shell which forms the outer shell of *setae* anchored pile system 100. Like the bivalve shell of a razor clam, two-part shell 130 preferably provides an outer shell for *setae* anchored pile system 100 that can expand laterally because its two halves can separate from each other during expansion of pile system 100. As with pile system 10, two-part shell 130 of pile system 100 can also be formed from more than two parts. Thus, discussions herein which relate to the two-part shell 130 are intended to also be applicable to shells 130 formed from more than two parts.

Another objective of this embodiment of the present invention is to enhance the load-carrying capacity of a pile or soil anchor by employing the natural characteristics of *setae*, the bristle or hair-like objects that extend from earthworms to anchor their body while burrowing. Referring to FIGS. 4A-6, embodiments of *setae* anchored pile system 100 preferably comprise mechanical expansion devices 110 and projections (also called "bristles") 120. Preferably, mechanical expansion devices 110 are capable of expanding and contracting, for example with a jackscrew and/or in a manner similar to that of a scissor jack. Expansion devices 110 are preferably attached, which can optionally include by welding, bolting or some other manner of fastening or forming, to the inside surface of two-part shell 130, so that each of the halves of two-part shell 130 moves outwards as mechanical expansion devices 110 are opened. When mechanical expansion devices 110 are opened, two-part shell 130 preferably expands radially (or at least substantially laterally) against the surrounding soil and increases the lateral earth pressure. In some embodiments, mechanical expansion devices 110 are devices with an apparatus other than a jackscrew, including but not limited to, hydraulically driven jacks.

Preferably, projections 120 are radially (or at least substantially laterally) directed structures that can be welded, attached or otherwise formed on the outer surface of two-part shell 130, as perhaps best illustrated in FIG. 6. When mechanical expansion devices 110 are expanded laterally, they force the parts of two-part shell 130 away from one another, thus expanding two-part shell 130 radially (or at least substantially laterally) against the surrounding soil, and projections 120 on the outside of two-part shell 130 penetrate the surrounding soil like the *setae* that extend from earthworms to anchor their body while burrowing. Projections 120 can optionally have a shape as illustrated in FIG. 6, which is a pointed, triangular shape. Alternatively, the shape of projections 120 can have any of various forms depending on factors such as the environment of pile system 100. As a non-limiting example, projections 120 can include any of the following shapes: rectangular, half-cone-like, wedge-like, plate-like, spiky, ribs, any combination thereof and the like.

Embodiments of *setae* anchored pile system 100 can optionally include a remote opening mechanism for remotely opening/expanding and closing/contracting mechanical expansion devices 110. Because mechanical expansion devices 110 can be deep within two-part shell 130, each mechanical expansion device 110 of the series of mechanical expansion devices 110 within two-part shell 130 preferably coordinate with a system to open and close all of them, most preferably simultaneously. In one embodiment, center rod 140, which is most preferably formed from a metal material, is preferably connected to each mechanical expansion device 110 and serves to open and close them remotely from the ground surface. Other embodiments of *setae* anchored pile system 100 can optionally be actuated by ropes, wires, cables, hydraulics, poles, combinations thereof, and the like.

*Setae* anchored pile system 100 can be particularly useful in combination with bored piles. For example, a borehole is dug and supported with bentonite slurry or drilling mud unless the walls of the borehole can remain open and stable without aid. Then, as illustrated in FIG. 4, two-part shell 130, including an assembly of a series of mechanical expansion devices 110 within it, is lowered into the borehole while mechanical expansion devices 110 are in a closed/contracted configuration. Subsequently, the mechanical expansion devices 110 are progressively opened/expanded until the two halves of two-part shell 130 are in contact with and putting a desired lateral pressure on the borehole walls, and the projections are preferably fully inserted into the surrounding soil, as illustrated in FIGS. 5 and 6. As mechanical expansion devices 110 push two-part shell 130 outwards, toward the surrounding soil, the lateral earth pressure on two-part shell 130 increases to provide much more anchorage which leads to greater shaft resistance for *setae* anchored pile system 100 when loads from a superstructure are applied. This also inserts projections 120 into the surrounding soil to form another anchorage mechanism. After mechanical expansion devices 110 are expanded laterally to the desired amount of expansion, two-part shell 130 can optionally be filled with filler material 34 and rebar or other members or components can be embedded therein to engage a subsequently installed superstructure. A top slab 36 can be formed at a top-portion of *setae* anchored pile system 100. If desired, base plate 39 can also be added atop top slab 36 and rebar dowels 40 can be embedded within filler material and can extend up through top slab 36, and if provided, up through base plate 39 to wait for superstructure construction.

Figure 7A:
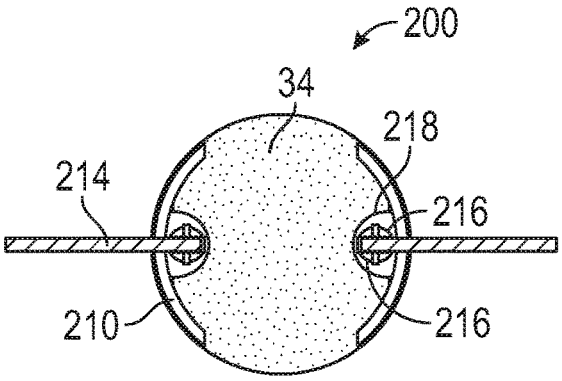
FIGS. 7A and 7B are drawings that respectively illustrate sectional view and a sectional side-view of an expansive pile having elongated members that extend at least substantially laterally therefrom according to an embodiment of the present invention.
Figure 7B:
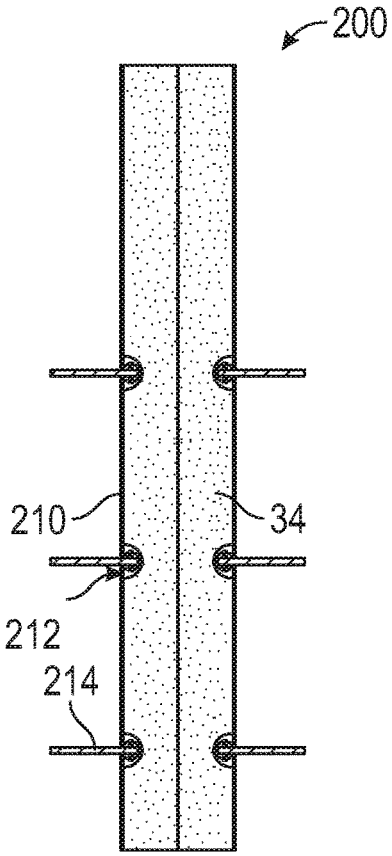

Referring now to FIGS. 7A and 7B, in one embodiment, expansive pile 200 containing two-part shell 210 can feature openings 212 in one or both of two-part shell 210, through which elongated holding members 214 are extended. In one embodiment, elongated holding members 214 can comprise rods, bolts, pipes, or any other structure which can be caused to project out of openings 212 and into the surrounding soil. In one embodiment, elongated holding members 214 can comprise a threaded end which engages with one or more nuts 216, which can optionally comprise a pair of spherical nuts. In one embodiment, nut cap 218 can be positioned inside of two-part shell 210 such that filler material 34 does not contact elongated holding members 214, or nuts 216. Most preferably, expansive pile 200 is disposed within an opening in the ground. Then, two-part shell 210 is preferably expanded and then elongated holding members 214 are expanded or pushed into the soil. Optionally, however, two-part shell 210 can expand simultaneously with or can expand after elongated holding members are extended out of openings 212. As with the preceding embodiments of piles/anchors, expansive pile 200 can expand in a manner similar to that of pile system 10 or 100 and the teachings of two-part shell 12 and/or 130 are equally applicable to two-part shell 210. Thus, two-part shell 210 can comprise a multi-part shell comprising more than two-parts.

Expansive pile 200 is occasionally referred to herein as a bio-inspired root anchored pile ("BRAP") and incorporates inspiration from the anchorage approach of the Laminariales and lateral roots. The extension of elongated holding members 214 can be accomplished via any known method for extending an elongated member and is preferably accomplished from within an interior of two-part shell 210. In one embodiment, elongated holding members 214 can be rotated so as to cause the end portion of them to be forced out away from nuts 216 for example, by unscrewing them.

Like in the anchorage of lateral roots of plants, downward or upward forces on pile 200 preferably cause elongated holding members 214 to slightly rotate up or down, respectively, to mobilize the surrounding soil and provide resistance against the axial loading. Elongated holding members 214 do not need to have a large cross-sectional area to provide shear resistance against vertical loading. Instead, a hinge-type connection, which can optionally be provided with a spherical nut, at the interior end of elongated holding members 214 allows elongated holding members 214 to rotate partially and mobilize their tensile strength. Nut caps 218 can optionally be individually applied around each opening or can optionally be formed by an elongated continuous opening that extends down the length of pile 200 (for example, by welding half of a smaller diameter pipe (i.e. a section of a smaller-diameter pipe that has been split lengthwise) down the inside of each part of two-part shell 210). In one embodiment, after the shell and anchor bolts are installed, the shell inner space can be filled with concrete and steel reinforcement as needed for any structural requirements and can be topped with pile cap 36 and, if desired, a base plate 39. Features of this pile system can be used as enhancements to conventional large diameter drilled shafts.

Figure 12:
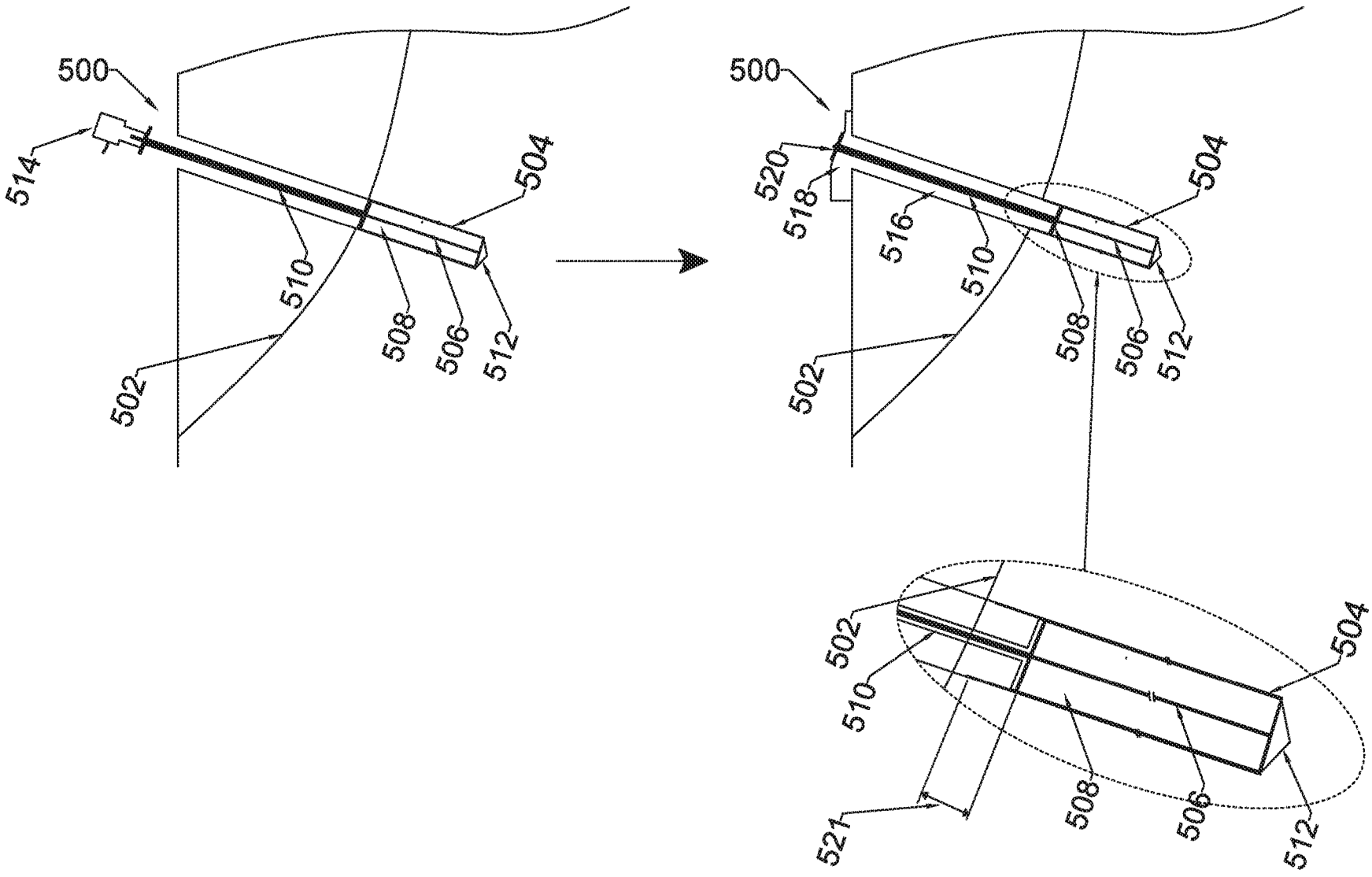
FIGS. 12 and 13 are sectional side view drawings which illustrate embodiments of bio-inspired expansive soil anchors in an installed pre-expansion and post-expansion configuration according to embodiments of the present invention.

Referring now to FIG. 12, an embodiment of soil anchor 500 (occasionally referred to herein as a bio-inspired expansive soil anchor ("BESA")) is illustrated. Soil anchor 500 is installed and expanded as described for pile system 10. The teaching for similar or corresponding components of pile system 10 are thus applicable to soil anchor 500. As illustrated in FIG. 12, the following reference numbers and their associated descriptions follow:

502—Potential failure surface

504—Pipe with a longitudinal cut (note: this one is not two-part—it has only one cut, so it holds the nearly incompressible core but still allows expansion)

506—Rod (tendon)

508—Nearly incompressible core

510—Steel pipe with circular plates (disks) at two ends of the pipes

512—Driving shoe

514—Hydraulic jack to pull the rod

516—Grout

518—Concrete

520—Bearing plate

521—Length reduction due to core compression

Figure 13:
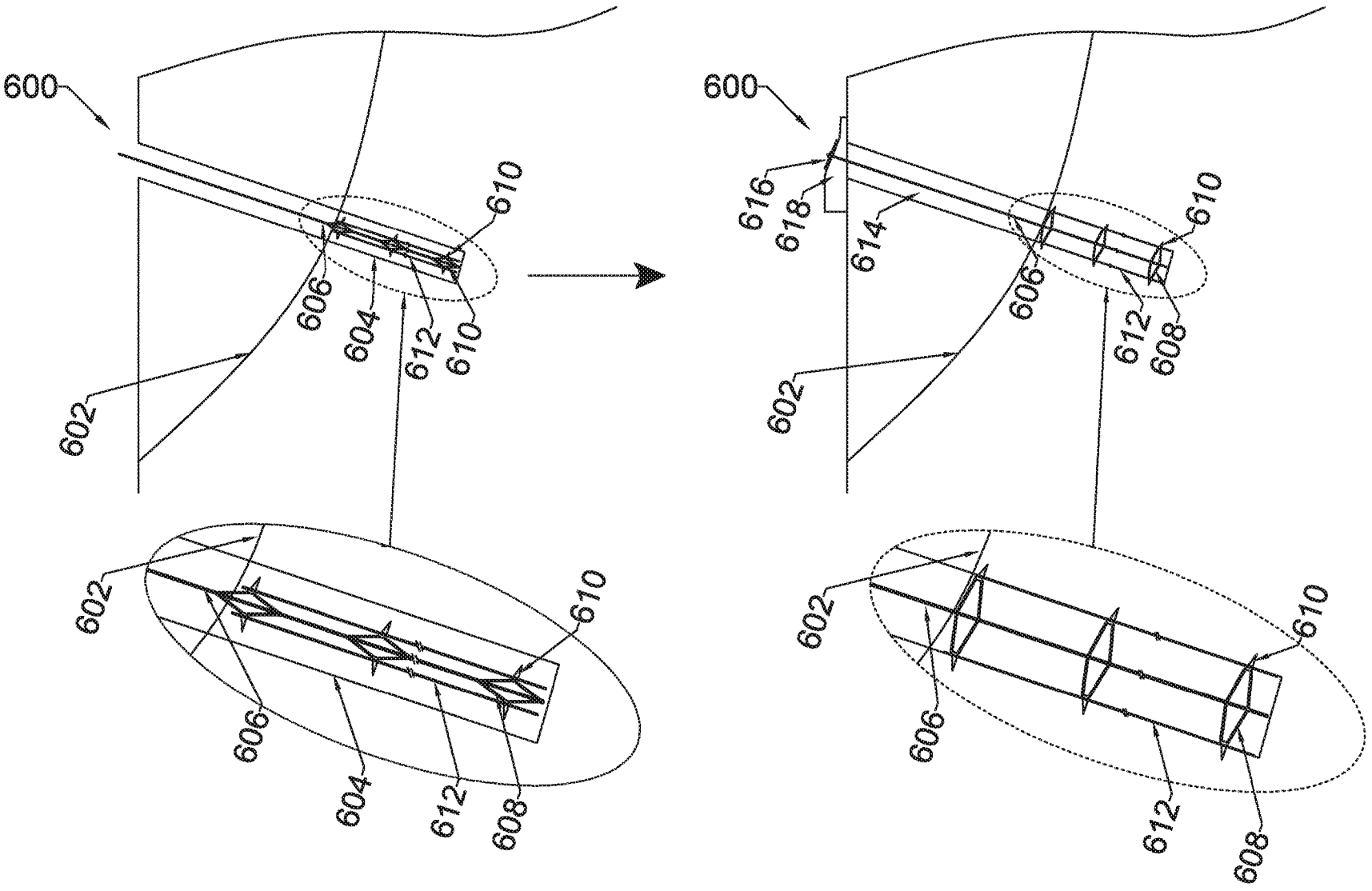

FIG. 13 illustrates an embodiment of soil anchor 600 (occasionally referred to herein as a bio-inspired *setae* soil anchor ("BSSA"). Soil anchor 600 is installed and expanded as described for anchored pile system 100. The teaching for similar or corresponding components of pile system 100 are thus applicable to soil anchor 600. As illustrated in FIG. 13, the following reference numbers and their associated descriptions follow:

602—Potential failure surface

604—Drilled hole

606—Center rod

608—Jackscrew

610—Projections (bristles)

612—Two-part (or Two-arc) shell

614—Grout

616—Bearing plate

618—Concrete

INDUSTRIAL APPLICABILITY

The invention is further illustrated by the following non-limiting examples.

Example 1

A numerical modeling example of the laterally expansive pile subjected to downward axial loading is described. The numerical analysis was performed using the finite element (FE) software ABAQUS® 2017 (ABAQUS is a registered trademark of Dassualt Systemes Simulia Corp.). For this example, a laterally expansive pile, according to an embodiment of the present invention, was compared to a conventional cylindrical pile with the same dimensions (i.e., length=10 m, outer diameter=0.3 m) in terms of the lateral confining pressure developed along the pile shaft and the load capacity. The expansive pile was comprised of a two-part cylindrical steel shell (thickness=8 mm) and a nearly incompressible core (length=6 m). The conventional pile was a close-ended steel pipe pile. The steel of the piles and the nearly incompressible core were considered linear elastic. The Young's modulus and Poisson's ratio were found to be 210 GPa and 0.3 for the steel and 0.1 GPa and 0.48 for the nearly incompressible core, respectively. The Poisson's ratio of the steel and the nearly incompressible core are assumed to be 0.3 and 0.48, respectively. The adopted values of these parameters are within the typical ranges for the materials considered.

In this case, the piles were assumed to be installed in a sand deposit with properties as those of the Erksak 330/0.7 sand, which is composed mostly of quartz particles with a trace of silt. A unified critical state constitutive model referred to as clay and sand model ("CASM") was used to describe the sand mechanical behavior during pile loading. The CASM material parameters of the sand were: Compression index $\lambda$=0.0135; specific volume at mean normal stress of 1 kPa $\Gamma$=1.8167, Poisson's ratio v=0.3; reloading index $\kappa$=0.005; slope of the critical state line M=1.2; initial state parameter $\xi_R$=0.075; and stress state coefficient n=4.0. The pile models were analyzed for two sand densities: medium dense sand with initial specific volume $v_o$=1.667 and very dense sand with $v_o$=1.59.

Figure 8A:
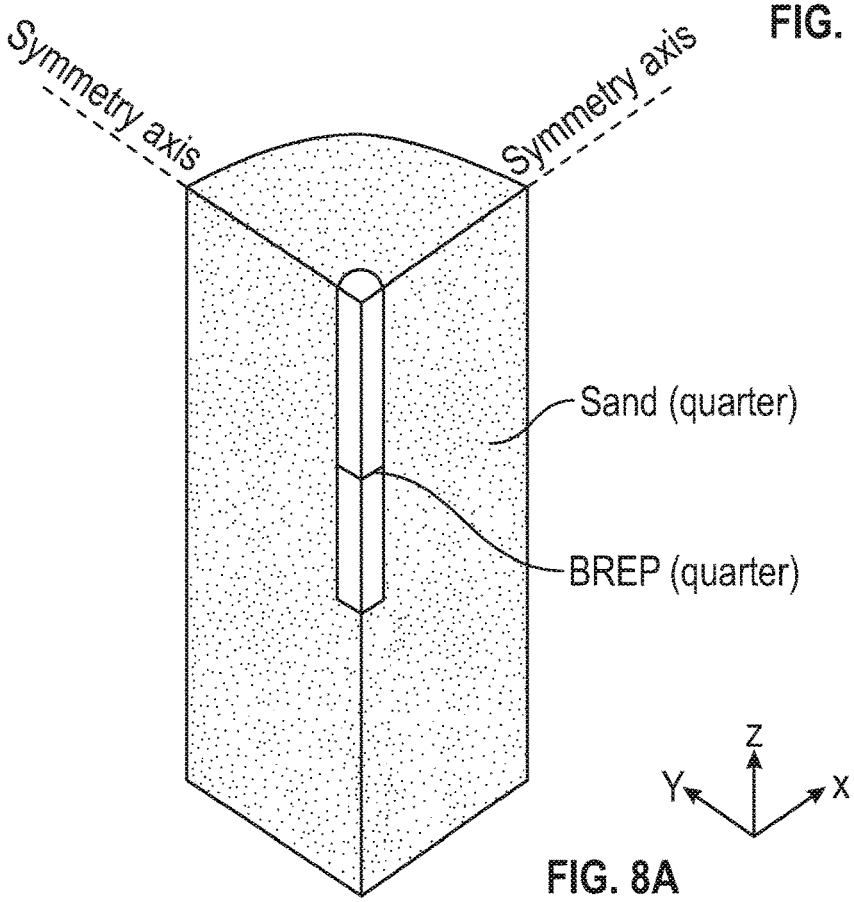
FIGS. 8A and 8B are drawings of finite element models for an expansive pile which respectively illustrate a quarter model and the boundary conditions and other features of the model.
Figure 8B:
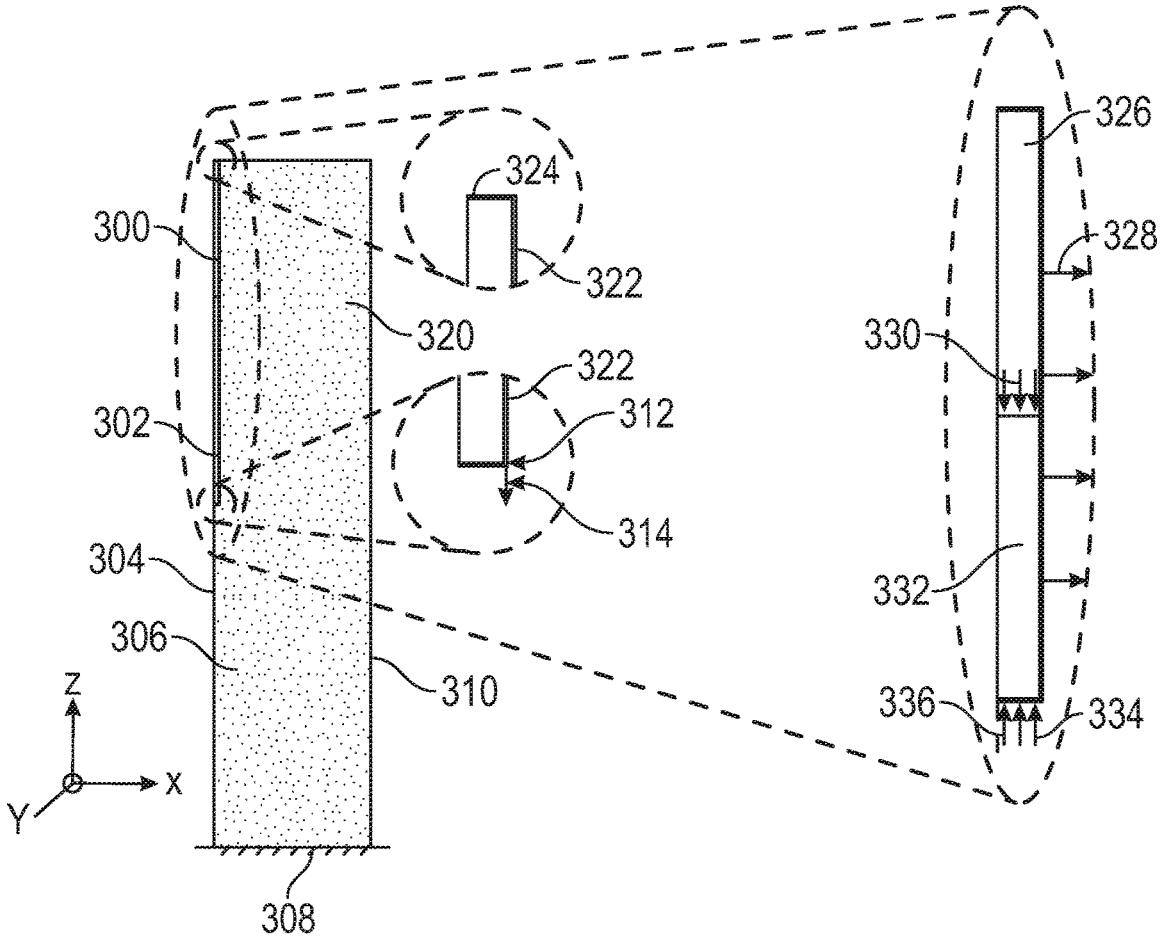

Taking advantage of the problem symmetry shown in FIG. 8A, the model was only of a quarter of the problem. Boundary conditions and other details of the FE model of the laterally expansive pile are shown in FIG. 8B. In FIG. 8B, the reference numbers describe aspects of the model as follows:

300—Split steel pipe, only a quarter of a full shell is modeled due to the symmetry;

302—Nearly incompressible core, only a quarter of a cylinder is modeled due to the symmetry;

304—Boundary Conditions ("BC"): Rollers on entire plane, no displacement in X direction, rollers on split steel pipe section are deactivated in step 2 (plane symmetry);

306—BC: Rollers on entire plane, no displacement in Y direction (plane of symmetry);

308—BC: Fixed bottom;

310—BC: Allowed only to move vertically in Z direction;

312—Rigid Disk and Reference Point ("RP"). Axial load in Z direction is applied on this reference point ("RP") in a separate step (step 3) after end of expansion;

314—Axial load;

320—Sand;

322—Split steel pipe;

324—Rigid disk and RP allowed only to move vertically in Z direction;

326—Split steel pipe;

328—Lateral expansion of split shell due to the expansion of incompressible core;

330—Compression of nearly incompressible core in a separate step (step 2);

332—Nearly incompressible core;

334—Compression of nearly incompressible core in a separate step (step 2); and

336—Split line.

The FE analysis included three steps. The first step was the geostatic step, in which the self-weight of the materials including the soil overburden pressure and the initial lateral soil confining pressure were applied. In the second step, the pile shell was expanded laterally by the axial compression of the pile core (static loading).

Figure 9:
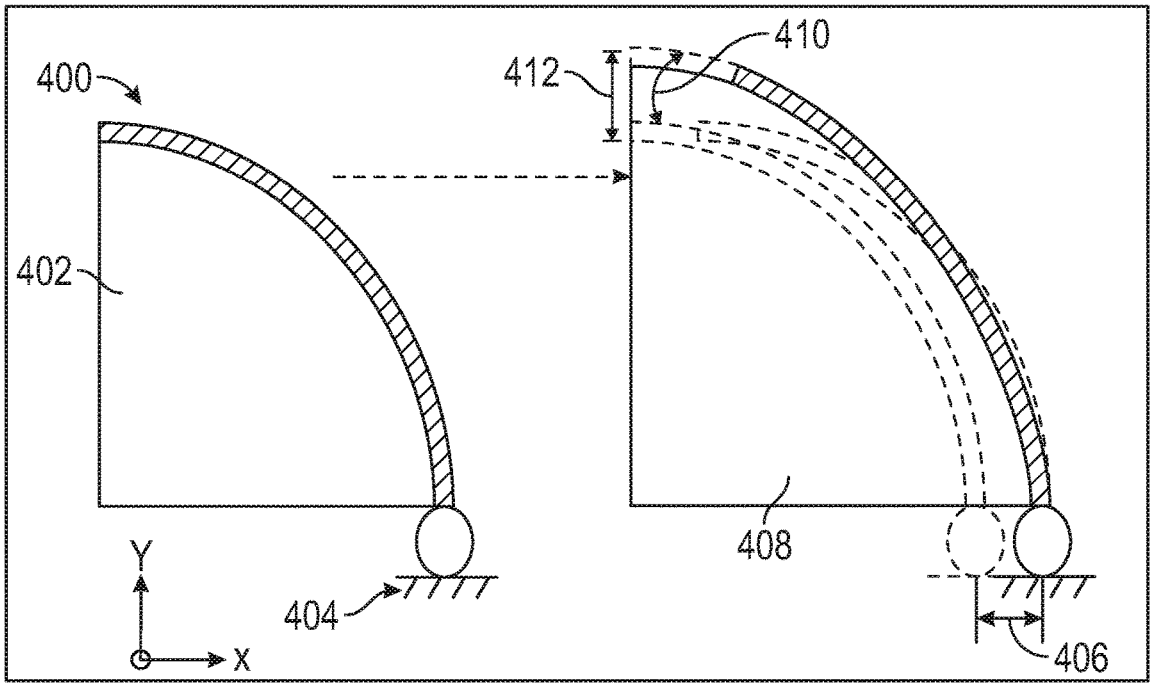
FIG. 9 is a drawing which schematically illustrates a section of half of one of the two parts of the split steel pile according to an embodiment before and after expansion.

FIG. 9 illustrates schematically the expansion (progressing from non-expanded, on the left to expanded on the right) of the nearly incompressible core and the deformation of the split steel pipe section in the second step of the FE analysis. In FIG. 9, the reference numbers describe aspects of the schematic representation as follows:

400—Boundary Condition ("BC"); Free end (rollers are deactivated in step 2);

402—Nearly incompressible core before compression in the Z direction;

404—BC; Rollers on split steel pipe in Y direction;

406—Translation in X direction due to the expansion;

408—Lateral expansion of nearly incompressible core due to the compression in the Z direction;

410—Rotation of the free end of the split steel pipe due to expansion; and

412—Expansion in Y direction.

In the second step, the roller supports on the split steel shell section were deactivated in the X-direction to allow lateral movement (expansion) of the pile, but the roller supports in the Y direction stayed active so that the pile did not move in the Y direction even though the pile was able to expand in the Y direction because the steel section was able to dilate as a result of the core compression. The third step of the analysis consisted of the vertical (axial) downward loading of the expanded pile. The vertical pile loading was applied with a prescribed vertical downward displacement.

Figure 10A:
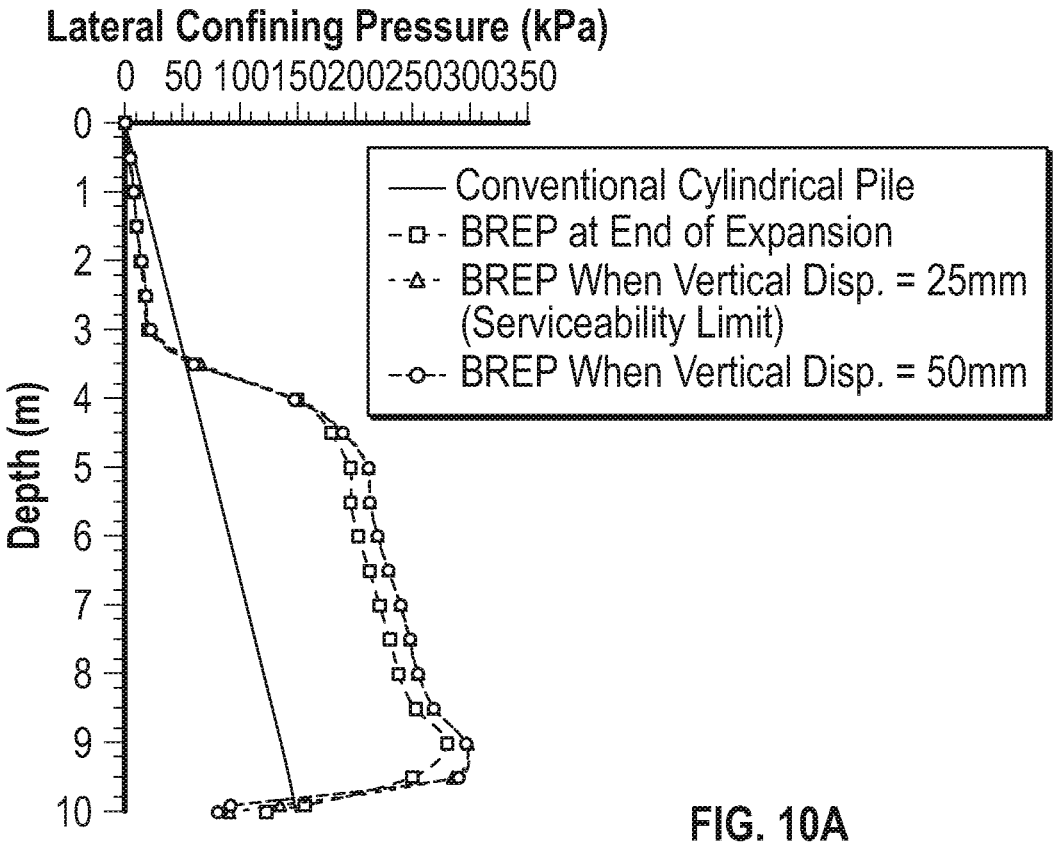
FIGS. 10A and 10B are graphs which respectively illustrate a confining pressure on a laterally expansive pile and a conventional cylindrical pile in medium dense sand and in very dense sand.
Figure 10B:
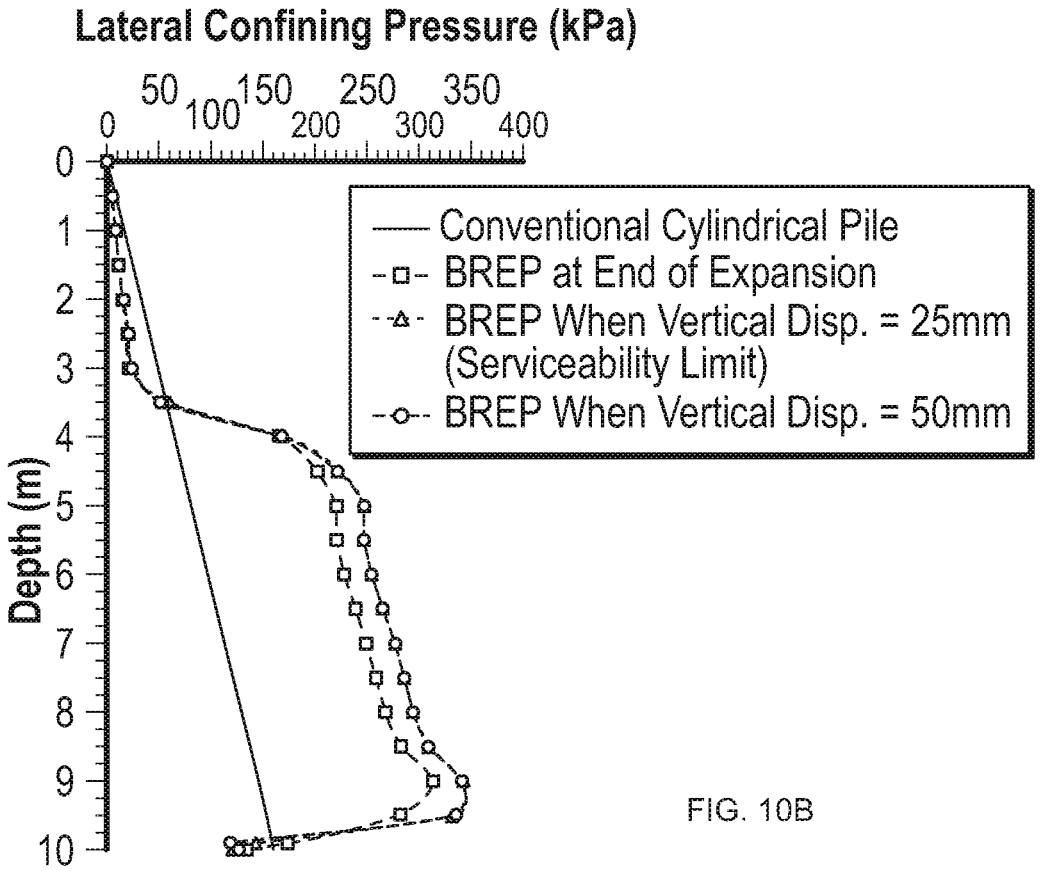

FIGS. 10A and 10B compare the lateral confining pressure on a section of the pile developed in the laterally expansive pile and the conventional cylindrical pile in medium dense and very dense sand, respectively. The lateral expansion of the pile (prior to vertical loading) lead to a significant increase in the lateral confining pressure along the expanded section of the pile compared to the conventional cylindrical pile. To quantify this enhancement, a parameter herein referred to as a confining force (Fc), defined as the area within the lateral confining pressure curve, is introduced. For the medium dense sand, Fc of the laterally expansive pile was 78% greater than Fc of the conventional pile. For the very dense sand, Fc of the laterally expansive pile was 84% greater. As illustrated in FIGS. 10A and 10B, the greatest increase in lateral confining pressure occurred along the expanded core, which in this example was located at the bottom 6 m of the laterally expansive pile (The length of the nearly incompressible core was 6 m in this case). The lateral confining pressure in the lowest 6 m of the expanded pile was almost more than twice that of the conventional pile along the same region along the pile shaft. FIGS. 10A and 10B also show the lateral confining pressure curves along the expansive pile at two stages of the applied vertical load. One stage was when the vertical pile displacement was 25 mm, that can be considered as a serviceability limit for the pile. The other stage was when the vertical pile displacement was twice the serviceability limit. These two confining pressure curves indicate that the improvement in the lateral confining pressure obtained at the end of pile expansion is maintained even after the vertical load was applied.

Figure 11A:
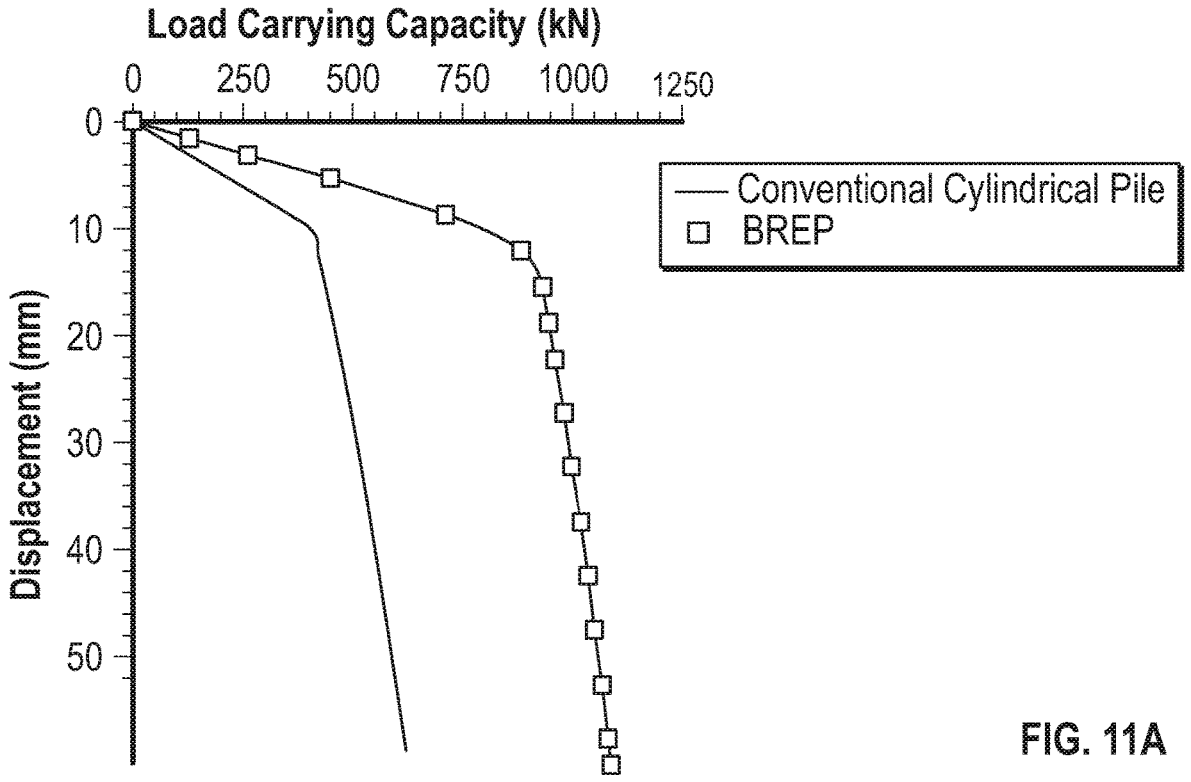
FIGS. 11A and 11B are graphs which respectively illustrate load carrying capacity of a laterally expansive pile and a conventional pile in medium dense sand and in very dense sand.
Figure 11B:
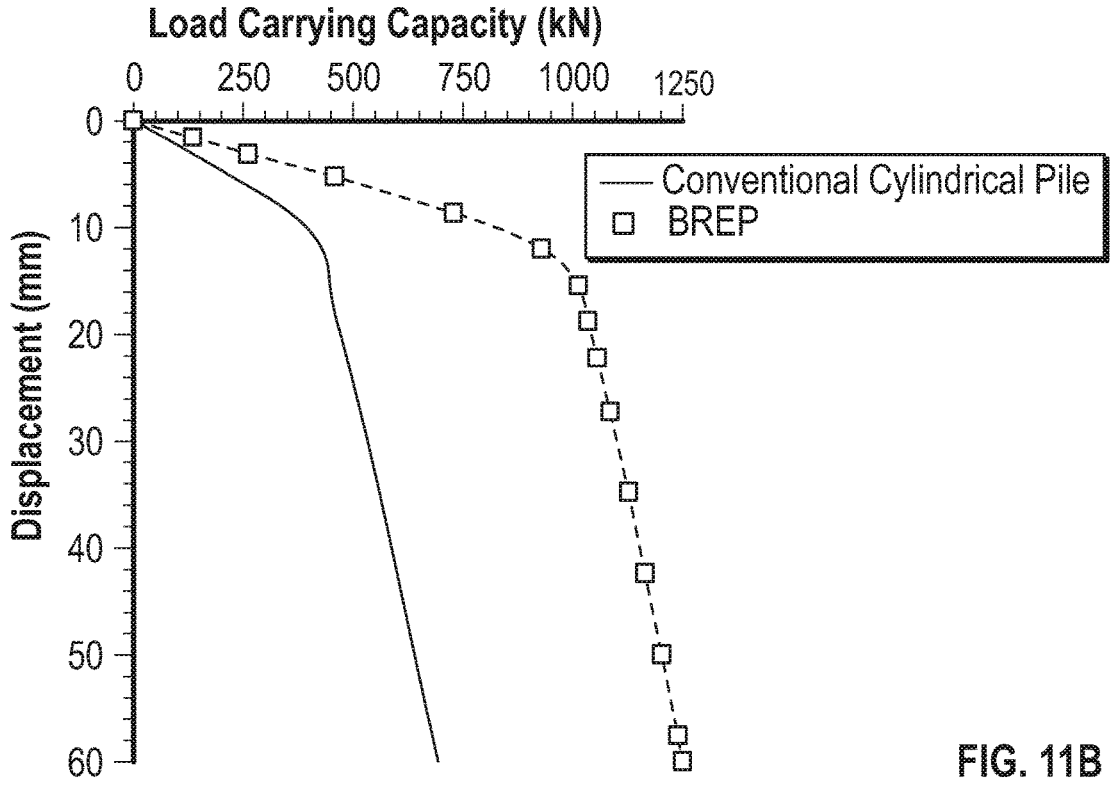

FIGS. 11A and 11B compare the load carrying capacity of the laterally expansive pile and the conventional cylindrical pile. There is a remarkable enhancement in downward capacity in the laterally expansive pile. FIGS. 11A and 11B show the load-displacement curves in the medium dense sand and the very dense sand, respectively. Using the tangent failure criterion method, the ultimate load capacity of the laterally expansive pile in the medium dense sand was 970 kN. The laterally expansive pile had 1.98 times greater (98% greater) ultimate load capacity than the conventional cylindrical pile. The ultimate load capacity of the laterally expansive pile in the very dense sand was 1200 kN, which was 2.18 times greater (118% greater) than the capacity of the conventional cylindrical pile in the very dense sand. Table 1 summarizes the FE analysis results.

TABLE 1

Summary of FE analysis results

| | Conventional cylindrical pile | | BREP | | |
|---|---|---|---|---|---|
| Density | Confining force (kN) | Ultimate capacity (kN) | Confining force (kN) | Ultimate capacity (kN) | Enhancement with BREP[a] |
| Medium | 830 | 490 | 1480 | 970 | 1.98 |
| Very Dense | 905 | 550 | 1670 | 1200 | 2.18 |

[a]Ratio of BREP ultimate capacity to ultimate capacity of the conventional pile.

The preceding examples can be repeated with similar success by substituting the generically or specifically described components and/or operating conditions of embodiments of the present invention for those used in the preceding examples.

Note that in the specification and claims, "about" or "approximately" means within twenty percent (20%) of the numerical amount cited. Embodiments of the present invention can include every combination of features that are disclosed herein independently from each other. Although the invention has been described in detail with particular reference to the disclosed embodiments, other embodiments can achieve the same results. Variations and modifications of the present invention will be obvious to those skilled in the art and it is intended to cover in the appended claims an such modifications and equivalents. The entire disclosures of all references, applications, patents, and publications cited above are hereby incorporated by reference. Unless specifically stated as being "essential" above, none of the various components or the interrelationship thereof are essential to the operation of the invention. Rather, desirable results can be achieved by substituting various components and/or reconfiguration of their relationships with one another.

What is claimed is:

1. An earth anchor/pile system comprising:

a multiple-part shell formed from a plurality of elongated members;

at least two tensioning members, each of said at least two tensioning members coupled to a respective one part of said multiple-part shell, said at least two tensioning members configured to extend above a top slab;

said plurality of elongated members configured to move away from one another to provide an expanded configuration of said earth anchor/pile system;

said plurality of elongated members configured to move toward one another to provide a contracted configuration of said earth anchor/pile system; and said earth anchor/pile system securable in said expanded configuration.

2. The earth anchor/pile system of claim 1 further comprising a core disposed within at least a lower portion of said multiple-part shell.

3. The earth anchor/pile system of claim 2 further comprising a driving shoe disposed at an end portion of said multiple-part shell.

4. The earth anchor/pile system of claim 2 wherein said multiple-part shell comprises a two-part shell.

5. The earth anchor/pile system of claim 2 wherein said plurality of elongated members comprise a plurality of curved elongated members.

6. The earth anchor/pile system of claim 2 wherein said multiple-part shell comprises an at least substantially circular shape when in the contracted configuration.

7. The earth anchor/pile system of claim 2 further comprising a filler material disposed within at least an upper portion of said multiple-part shell.

8. The earth anchor/pile system of claim 1 wherein the top slab is formed above said multiple-part shell.

9. The earth anchor/pile system of claim 8 wherein forcing the top slab closer to a bottom end portion of said plurality of elongated members causes said plurality of elongated members to move away from one another, thus expanding said earth anchor/pile system.

10. The earth anchor/pile system of claim 1 wherein said at least two tensioning members extend through the top slab.

11. The earth anchor/pile system of claim 1 wherein said earth anchor/pile system is configured to expand when said plurality of elongated members are placed in tension.

12. The earth anchor/pile system of claim 1 further comprising a plurality of mechanical expansion devices disposed within said multi-part shell and configured such that actuation of said plurality of mechanical expansion devices forces said elongated members to move away from each other or closer to each other.

13. The earth anchor/pile system of claim 12 further comprising a plurality of projections that project at least substantially laterally away from an outside surface of said multiple-part shell.

14. The earth anchor/pile system of claim 13 wherein said plurality of projections comprise metal spikes or metal elongated members.

15. The earth anchor/pile system of claim 13 wherein said plurality of projections are disposed on or incorporated into a surface of said plurality of elongated members.

16. The earth anchor/pile system of claim 13 wherein said plurality of elongated members comprises two elongated members.

17. The earth anchor/pile system of claim 12 wherein said plurality of mechanical expansion devices comprise a jackscrew and such that rotation of said jackscrew in a first direction causes said plurality of mechanical expansion devices to extend and such that rotation of said jackscrew in a second direction causes said plurality of mechanical expansion devices to retract.

18. The earth anchor/pile system of claim 12 wherein said earth anchor/pile system is securable in said expanded configuration by disposing filler material within an inner portion of said multiple-part shell when said multiple-part shell is in the extended configuration.

19. The earth anchor/pile system of claim 18 wherein said filler material comprises a cement material with or without steel reinforcement.

20. The earth anchor/pile system of claim 1 wherein said plurality of elongated members comprise one or more openings through which one or more elongated holding members project.

21. An earth anchor/pile system comprising:

a multiple-part shell formed from a plurality of elongated members;

said plurality of elongated members configured to move away from one another to provide an expanded configuration of said earth anchor/pile system;

said plurality of elongated members configured to move toward one another to provide a contracted configuration of said earth anchor/pile system;

a core disposed within at least a lower portion of said multi-part shell;

a filler material disposed within at least an upper portion of said multi-part shell;

a top slab disposed above said multi-part shell;

a plurality of tension members extending above said top slab and connected to one or more of said plurality of elongated members; and said earth anchor/pile system securable in said expanded configuration.

22. The earth anchor/pile system of claim 21 wherein said earth anchor/pile system is configured to expand when said plurality of elongated members are placed in tension.

23. An earth anchor/pile system comprising:

a multiple-part shell formed from a plurality of elongated members;

said plurality of elongated members configured to move away from one another to provide an expanded configuration of said earth anchor/pile system;

said plurality of elongated members configured to move toward one another to provide a contracted configuration of said earth anchor/pile system;

a core disposed within at least a lower portion of said multi-part shell;

a filler material disposed within at least an upper portion of said multi-part shell;

a top slab disposed above said multi-part shell, wherein forcing said top slab closer to a bottom end portion of said plurality of elongated members causes said plurality of elongated members to move away from one another, thus expanding said earth anchor/pile system; and said earth anchor/pile system securable in said expanded configuration.

24. An earth anchor/pile system comprising:

a multiple-part shell formed from a plurality of elongated members;

said plurality of elongated members configured to move away from one another to provide an expanded configuration of said earth anchor/pile system;

said plurality of elongated members comprising one or more openings through which one or more elongated holding members project;

said plurality of elongated members configured to move toward one another to provide a contracted configuration of said earth anchor/pile system; and said earth anchor/pile system securable in said expanded configuration.

* * * * *